US010781655B2

(12) United States Patent
Moyes

(10) Patent No.: US 10,781,655 B2
(45) **Date of Patent: *Sep. 22, 2020**

(54) JARRING APPARATUS

(71) Applicant: Rotojar Innovations Limited, Banchory, Aberdeenshire (GB)

(72) Inventor: Peter Barnes Moyes, Banchory (GB)

(73) Assignee: Rotojar Innovations Limited, Aberdeenshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/180,676

(22) Filed: Nov. 5, 2018

(65) Prior Publication Data

US 2019/0071945 A1 Mar. 7, 2019

Related U.S. Application Data

(62) Division of application No. 14/778,428, filed as application No. PCT/GB2014/051212 on Apr. 17, 2014, now Pat. No. 10,280,700.

(30) Foreign Application Priority Data

Apr. 19, 2013 (GB) ..... 1307112.1

(51) Int. Cl.
*E21B 31/107* (2006.01)
*E21B 31/113* (2006.01)
*E21B 31/00* (2006.01)

(52) U.S. Cl.
CPC ..... *E21B 31/107* (2013.01); *E21B 31/005* (2013.01); *E21B 31/113* (2013.01)

(58) Field of Classification Search
CPC ..... E21B 31/005; E21B 31/107
See application file for complete search history.

(56) References Cited

U.S. PATENT DOCUMENTS

| | | | |
|---|---|---|---|
| 1,653,093 | A | 12/1927 | Fleming |
| 1,653,094 | A | 12/1927 | Fleming |
| 1,901,513 | A | 3/1933 | Harris |
| 2,126,241 | A | 8/1938 | Black |
| 2,144,810 | A | 1/1939 | Raymond |
| 2,146,454 | A | 2/1939 | Sutliff |
| 2,153,883 | A | 4/1939 | Foster |

(Continued)

FOREIGN PATENT DOCUMENTS

| | | |
|---|---|---|
| GB | 2472720 B | 6/2012 |
| WO | WO-2009/134886 A2 | 11/2009 |

OTHER PUBLICATIONS

International Search Report PCT/ISA/210 for International Application No. PCT/GB2014/051212 dated Apr. 17, 2014.

(Continued)

*Primary Examiner* — Benjamin F Fiorello
(74) *Attorney, Agent, or Firm* — Harness, Dickey & Pierce, P.L.C.

(57) ABSTRACT

A downhole jarring apparatus for use in jarring an object in a bore comprises a first jarring portion including a first impact surface and a second jarring portion including a second impact surface. The apparatus includes a rotatable jarring arrangement operable to translate a rotational drive movement to cause relative axial movement of the first and second impact surfaces to establish axial impact therebetween.

20 Claims, 6 Drawing Sheets

(56) References Cited

U.S. PATENT DOCUMENTS

| | | | | |
|---|---|---|---|---|
| 2,474,459 | A | 6/1949 | Beck | |
| 2,671,640 | A | 3/1954 | Baker | |
| 2,733,045 | A * | 1/1956 | Burns | E21B 31/113 175/232 |
| 3,132,707 | A | 5/1964 | Alexander | |
| 3,139,933 | A | 7/1964 | Golden | |
| 3,199,933 | A | 8/1965 | Rogerson et al. | |
| 3,203,482 | A | 8/1965 | Lyles | |
| 3,406,770 | A | 10/1968 | Arterbury | |
| 3,713,481 | A | 1/1973 | Webb | |
| 4,498,548 | A | 2/1985 | Teng | |
| 4,576,229 | A | 3/1986 | Brown | |
| 4,844,157 | A | 7/1989 | Taylor | |
| 4,848,454 | A | 7/1989 | Spears | |
| 4,890,682 | A | 1/1990 | Worrall et al. | |
| 5,503,228 | A * | 4/1996 | Anderson | E21B 31/1135 166/178 |
| 5,875,842 | A | 3/1999 | Wyatt | |
| 5,906,239 | A | 5/1999 | Oettli | |
| 6,082,457 | A * | 7/2000 | Best | E21B 17/05 166/301 |
| 6,845,818 | B2 | 1/2005 | Tutuncu et al. | |
| 7,178,611 | B2 * | 2/2007 | Zupanick | E21B 7/067 175/107 |
| 7,191,852 | B2 | 3/2007 | Clayton | |
| 7,293,614 | B2 * | 11/2007 | Rose | E21B 31/1135 166/178 |
| 7,882,906 | B1 | 2/2011 | DeCuir, Sr. | |
| 2012/0118641 | A1 * | 5/2012 | Sheehan | E21B 31/107 175/57 |
| 2013/0062052 | A1 * | 3/2013 | Saheta | E21B 31/1135 166/178 |

OTHER PUBLICATIONS

Written Opinion of the International Searching Authority PCT/ISA/237 for International Application No. PCT/GB2014/051212 dated Apr. 17, 2014.

* cited by examiner

JARRING APPARATUS

CROSS-REFERENCE TO RELATED APPLICATION(S)

This application is a Divisional application of U.S. application Ser. No. 14/778,428, filed Sep. 18, 2015, which is a National Phase of PCT/GB2014/051212, filed Apr. 17, 2014; which claims priority under 35 U.S.C. § 119 to Great Britain Application No. 13071121, filed on Apr. 19, 2013, in the Great Britain Property Office (GBPO), the entire contents of each of which are incorporated herein by reference.

FIELD OF THE INVENTION

The present invention relates to a jarring apparatus for use in jarring an object within a bore, such as a wellbore.

BACKGROUND TO THE INVENTION

Many industries require objects such as tools to be deployed through bores, such as wellbores in the oil and gas exploration and production industries, and there is always the risk of such objects becoming stuck in the bore. For example, wellbores may be drilled into the earth using long drill strings, which may become stuck, for example due to frictional engagement with the bore wall, due to collapse of the bore, due to differential pressures between the bore and surrounding formation pushing the drill string against a bore wall, due to binding with drill cuttings, or the like. Successful recovery of the drill string is of extreme importance and value to a drilling operator as the cost of failure to recover the tools and the well could run into several tens of millions of pounds.

Current methods for recovering stuck objects include impact tools known as jars which function to hammer or jar a stuck object. Drilling jars are universally employed globally by companies in the drilling and construction of oil and gas wells. However, current jarring technology has not changed or evolved for several decades, and is extremely limited in its functionality. For example, existing jarring tools may be considered to be slow, imprecise, hazardous, costly and damagingly large scale and slow rate.

Generally, a drilling jar is a mechanical device used downhole to deliver an impact load to another downhole component such as a bottom hole assembly (BHA). Known drilling jars operate by storing energy in a drilling string, for example by applying tension within the string, and suddenly releasing this energy to cause two impact surfaces to move axially and strike each other, creating an impact or jarring force within the drill string. This conventional drilling jar technology is known as a 'Linear Jarring' method and offers limited functionality and presents several significant drawbacks during its operation, such as:

- Each impact has a high recoil force which reverberates back to the rig, shaking and impacting the rig derrick and superstructure detrimentally.
- Time between impacts is lengthy—up to 2 minutes between impacts.
- The inability to readily adjust the magnitude of a generated jarring force, as this is conventionally set at a predetermined value prior to the drilling jar being deployed.
- Re-setting of the jar between impacts requires a force to be applied to the jar and drill-string in the opposite direction, consequently pushing the stuck drill-string back into the problem portion of the well.

- High amplitude/low frequency jarring (large impact force with long intervals between impacts, which is a feature of linear jarring) is often the cause of further hole collapse and can add to the problem which is trying to be resolved.
- High amplitude/low frequency impact performs poorly in freeing stuck pipe in clays and shales, which are a common rock type to cause sticking of pipe and hole instability.
- High amplitude/low frequency jarring performs poorly in addressing stick-slip binding of a drill string, in which a single jar only achieves a small slipping motion before the drill string sticks again.

Various drilling jarring tools and methods are disclosed in, for example, U.S. Pat. Nos. 7,882,906, 3,199,933, 1,653,093, 1,653,094, 1,901,513, 2,146,454, 2,153,883, 3,139,933, 4,890,682, 7,191,852, 4,576,229, WO 2009/134886 and U.S. Pat. No. 6,845,818.

SUMMARY OF THE INVENTION

An aspect of the present invention relates to a downhole jarring apparatus for use in jarring an object in a bore.

The apparatus may comprise an impact arrangement comprising opposing impact surfaces. The apparatus may comprise a rotatable jarring arrangement which is operable to translate a rotational drive movement to cause axial impact between the impact surfaces.

The apparatus may comprise multiple impact arrangements each comprising opposing impact surfaces. The impact arrangements may be operable simultaneously. The impact arrangements may be operable independently of each other.

According to an aspect of the present invention there is provided a downhole jarring apparatus for use in jarring an object in a bore, comprising:

a first impact surface;

a second impact surface; and a rotatable jarring arrangement operable to translate a rotational drive movement to cause relative axial movement of the first and second impact surfaces to establish axial impact therebetween.

In use, the apparatus may be engaged with an object, such as an object which has become stuck in a bore, and the first and second impact surfaces axially impacted together by operation of the rotatable jarring arrangement, thereby applying a jarring effect to the object. As this jarring effect is achieved by a rotational drive movement, the apparatus may be defined as a rotary jarring apparatus. Furthermore, as this jarring effect is achieved by a rotational drive movement, rather than a solely relative linear motion, problems associated with prior art linear jars may be at least partially addressed.

The first impact surface may be provided on a first jarring portion, and the second impact surface may be provided on a second jarring portion. The rotatable jarring arrangement may be associated with at least one of the first and second jarring arrangements.

The apparatus may be configured to assist in freeing a stuck object to permit removal of the object from the bore, and/or to permit further advancement of the object through the bore.

The apparatus may be configured to actuate or operate an object within a bore. For example, jarring of an object by the apparatus may cause the object to be actuated.

The apparatus may be configured for use within any suitable bore. In one embodiment the apparatus may be configured for use within a drilled bore, such as a drilled wellbore extending into the earth, for example to extend to a subterranean formation. The apparatus may be configured for use within an open or unlined drilled bore. The apparatus may be configured for use within a bore which is in the process of being drilled. The apparatus may be configured for use within the bore of a tubing structure, such as within a casing or liner tubing structure which lines a drilled bore, within a pipe-line, such as a surface or sub-surface pipe-line, or the like.

The apparatus may be configured to deploy an object in a bore. In such an arrangement any sticking or jamming of an object during such deployment may be addressed by the apparatus. In such an arrangement the apparatus may be configured in a disabled configuration during deployment of the object, with the apparatus reconfigured into a jarring configuration when jarring is required.

The apparatus may be configured to be engaged with an object already present within a bore. That is, the apparatus may be run into a bore, for example on a connected work string, until engagement of an object is achieved, and then used to assist to free said object.

The apparatus may be configured for use in jarring an object positioned below the apparatus in a bore. Alternatively, or additionally, the apparatus may be configured for use in jarring an object positioned above the apparatus. It should be understood, however, that the terms such as "upper", "lower", "above" and "below" are not intended to only be limited with reference to a vertical orientation. Instead, such terms should be assumed in relation to the entry point of a bore, such that a region nearer to an entry point may be defined as an upper region, and a region further from an entry point may be defined as a lower region.

The apparatus may be configured to be self-jarring. That is, the apparatus may be configured to provide a jarring force directed at itself.

The apparatus may be configured to permit axial jarring in one axial direction, such as an upwardly and downwardly direction. The apparatus may be configured to permit axial jarring in opposing axial directions, such as both upwardly and downwardly.

The magnitude of an axially applied force between the first and second impact surfaces may dictate the magnitude of a generated jarring force. The magnitude of the generated jarring force may be readily adjusted and controlled by appropriate variation of the applied axial force, for example by varying the tension and/or compression within an associated work string. This may avoid the limitations of prior art arrangements in which the jarring force of a jarring tool may be typically set at a predefined value prior to deployment of the tool, and cannot be varied while deployed.

The rotatable jarring arrangement may translate a rotational drive movement to cause axial separation of the first and second impact surfaces, and subsequent impact of the first and second impact surfaces to generate an impact therebetween.

The rotatable jarring arrangement may be configured to receive rotational drive movement from a rotational drive mechanism.

The rotational drive mechanism may be configured separately from the apparatus.

The apparatus may comprise a rotational drive mechanism.

The rotational drive mechanism may be coupled or otherwise associated with the rotatable jarring arrangement and configured to provide a rotational drive movement to the rotatable jarring arrangement.

The rotational drive mechanism may comprise a work string. In such an arrangement the rotatable jarring arrangement may be configured to receive rotational drive movement from an associated work string which may be coupled to the apparatus. In such an arrangement the associated work string may be defined as a rotatable work string.

The rotational drive mechanism may comprise a driving component, for example, an electric motor, pneumatic motor, hydraulic motor or the like.

The rotatable jarring arrangement may be at least partly defined by or within one or both of first and second jarring portions. The rotatable jarring arrangement may be interposed between the first and second jarring portions. At least a portion of the rotatable jarring arrangement may be defined by one or both of the impact surfaces.

The rotating jarring arrangement may be at least partly defined by a mechanism interposed between the first and second jarring portions which may be formed and arranged to convert relative rotating movement between the first and second jarring portions to relative linear movement between the first and second jarring portions. Such a mechanism may be provided remotely from at least one impact surface. Such a mechanism may be incorporated within at least one impact surface.

The rotatable jarring arrangement may be configured to effect relative axial translation of the first and second impact surfaces according to engagement of said surfaces and a rotational drive movement.

The first and second impact surfaces may define respective uneven surface profiles. The uneven surface profiles may be defined by surface variations in the associated impact surfaces. The first and second impact surfaces may be configured to be engaged and rotated relative to each other, for example by relative rotation of associated first and second jarring portions, established by a rotational drive mechanism such that rotating sliding engagement of the respective uneven surface profiles generates an impact force therebetween.

The respective profiles of the first and second impact surfaces may be configured to permit a rotational impact force to be generated therebetween upon relative rotating sliding engagement of the surfaces.

The apparatus may be configured to permit an axial force to be applied between the first and second impact surfaces, at least when the apparatus is in a jarring configuration, such that a combination of the axial force and relative rotation applied between the impact surfaces permits the respective profiles to generate an impact force therebetween. The axially applied force may function to press the first and second impact surfaces together. The axially applied force may be established by a connected work string. Such a connected work string may apply a compressive or tensile axial force to establish an axial force between the first and second impact surfaces.

Respective profiles of the first and second impact surfaces may be configured such that during rotating sliding engagement of the impact surfaces, portions of the surfaces become separated against the action of an axially applied force, and separated portions subsequently impacted together to generate the impact force. Such separation against the action of the axial force may permit energy to become stored to be subsequently released during impact of the surface portions. In embodiments where an axial force is applied between the first and second impact surfaces by a connected work string, energy may become stored within the connected work string, for example as tension or compression within said work string.

Respective profiles of the first and second impact surfaces may be configured such that separation of the impact surfaces occurs over a first time period, and subsequent impact following this separation occurs over a second time period which is shorter than the first time period. Such an arrangement may permit an increase in the impulse force which may be generated.

The profiles of the first and second impact surfaces may be defined by ramp structures circumferentially distributed around the impact surfaces, wherein rotatable interengagement of the ramp structures permits axial separation and reengagement of the surfaces. The profiles may be defined by teeth structures, such as serrated teeth, ratchet teeth or the like. The profiles may be defined by respective cam surfaces.

The rotatable jarring arrangement may comprise inter-engaging surfaces provided separately or remotely from the first and second impact surfaces, wherein the inter-engaging surfaces cooperate upon relative rotation to provide relative axial movement of the first and second impact surfaces to generate an impact force therebetween. In such an arrangement the inter-engaging surfaces may be provided between the first and second jarring portions.

The rotatable jarring arrangement may comprise an engaging member configured to engage with a circumferential surface. The engaging member may be associated with one of the first and second jarring portions, and the circumferential surface may be associated with the other of the first and second portions. A jarring effect may be achieved by relative rotation of the circumferential surface and engaging member.

The circumferential surface may be defined by a circumferential track. The circumferential track may comprise surface variations, for example, undulations, teeth or the like.

The circumferential surface may be configured in combination with an additional, axially-separated circumferential surface to define a slot therebetween. The slot may be configured to accommodate the engaging member. The engaging member and the slot may be configured to rotate relatively such that the engaging member may be engaged with at least one of the circumferential surfaces upon relative rotation of the engaging member and the slot.

The circumferential track may be rotated by the rotating drive movement.

The engaging member may be rotated or moved along a circumferential path by a rotating drive movement.

The engaging member may be configured to be continuously engaged with the circumferential track upon relative rotation of the engaging member and the circumferential track. The engaging member may comprise, for example, a pin, rod, plate or the like.

Relative rotational movement of the circumferential track and the engaging member may be achieved by rotating the engaging member relative to the circumferential track, which may be rotationally fixed within its associated jarring portion.

Relative rotational movement of the circumferential track and the engaging member may be achieved by rotating the circumferential track relative to the engaging member, which may be rotationally fixed within its associated jarring portion.

Relative rotational movement of the circumferential track and the engaging member may be achieved by rotating both the engaging member and the circumferential track, The engaging member may be configured to continuously engage with the circumferential track upon relative rotation of the engaging member and the circumferential track.

Relative rotational movement of the engaging member and the circumferential track may translate the relative rotational movement into relative axial movement of the first and second impact surfaces to facilitate axial impact therebetween.

The engaging member may be configured to extend radially from one of the first or second portions to engage with the track associated with the other of the first or second portions. The engaging member may extend outwardly from a central axis of the first or second portions. The engaging member may extend inwardly towards the central axis of the first or second portions.

The rotatable jarring arrangement may comprise a pressurising apparatus such as a pump and/or compressor configured to respond to or be driven by a rotating drive movement to provide fluid communication of an actuating fluid between first and second fluid reservoirs, for use in facilitating impact between the first and second impact surfaces.

The pressurising apparatus may be configured to provide a pressure differential between the first and second fluid reservoirs.

The pressurising apparatus may be configured in a pressurising stage, wherein the second fluid reservoir may be pressurised.

The pressurising apparatus may be configured in a de-pressurising stage, wherein the second fluid reservoir may be de-pressurised.

The pressurising apparatus may be configured in a disabled stage, wherein the pressurising apparatus may be prevented from providing fluid communication between first and second fluid reservoirs.

The pressurising apparatus may be configured in the pressurising stage to cause relative axial separation of the first and second impact surface. Upon pressurisation, actuating fluid may be communicated from the first fluid reservoir to the second fluid reservoir, thereby forcing the first and second impact surfaces to separate relatively in an axial direction.

The pressurising apparatus may be configured in the de-pressurising stage to de-pressurise the second fluid reservoir. The pressure in the second reservoir may be released upon reaching a threshold limit, for example, a maximal relative separation of the impact surfaces, at a pressure limit, or the like. Upon pressure release, actuating fluid may be communicated from the second reservoir to a first reservoir via a pressure release system. A conduit, flow path or the like may be selectively provided for communication of actuating fluid from second reservoir to the first reservoir. A valve system may be configured to maintain relative pressurisation of the first and second reservoirs, until the threshold limit may be achieved.

When provided in the de-pressurisation stage the second reservoir may de-pressurise by communicating actuating fluid from the second reservoir to the first reservoir, thereby permitting the first and second impact surfaces to move axially together such that an impact force may be generated therebetween.

The valve system may be configured to prevent fluid communication between the first and second reservoirs, thereby permitting re-pressurisation of the second reservoir according to rotational drive movement of the pressurising apparatus.

The pressurising apparatus may be configured to cycle between the de-pressurising state and the pressurising state to facilitate cyclical impact between the first and second impact surfaces.

The pressurising apparatus may be configured to generate multiple impacts upon subsequent cycles of pressurisation and de-pressurisation.

The rotatable jarring arrangement may comprise a rotating lobe arrangement, wherein the rotating lobe arrangement may be interposed between the first and second jarring portions, and wherein the rotating lobe arrangement may be configured to be rotated by the rotating drive movement for use in facilitating impact between the first and second impact surfaces.

The rotating lobe arrangement may comprise a lobe, for example, a cam, eccentric disc or the like, wherein the lobe may be configured to be engaged with a lobe contact surface, and wherein the lobe may be shaped to generate relative axial movement of the first and second impact surfaces upon rotation of the lobe relative to the lobe contact surface.

Rotation of the rotating lobe arrangement may facilitate impact between the first and second impact surfaces by rotating movement of the lobe relative to the additional surface.

The lobe may be configured to be frictionally engaged with the lobe contact surface, such that when rotated relative to the lobe contact surface the lobe translates in a direction, for example, a circumferential direction.

The lobe may be configured to be slidably engaged with the lobe contact surface, such that when rotated relative to the lobe contact surface, the lobe remains in a relative static location, for example, a relative static circumferential location.

The rotating lobe arrangement may comprise a plurality of lobes.

The rotatable jarring arrangement may be configured to generate at least one jar or jar event for a single full 360 degree revolution of an associated rotating drive movement. Accordingly, multiple revolutions of the rotating drive movement may be configured to generate multiple jars. This arrangement may permit multiple jars to be generated without requiring a complete resetting of the apparatus as may be required in known linear jarring tools.

The apparatus may be configured to generate multiple jars for a single 360 degree revolution of the rotating drive movement.

The jarring frequency of the apparatus may be dictated by the relative rotational velocity of an associated rotating drive movement, and the number of jars generated by the rotating drive movement for a single relative rotation.

The provision of a jarring force by use of the rotating drive movement may permit a higher jarring frequency to be achieved. The ability to achieve such higher frequencies may permit an object engaged with the apparatus to be effectively vibrated, rather than only receive the effect of a single or infrequent jarring force. This ability to effectively vibrate an object may provide significant advantages. For example, a higher jarring frequency or application of a vibratory force to any solid particulate which is in contact with an object, for example due to collapse of the bore, may result in a condition termed 'Solid Particulate Liquefaction'. This phenomenon essentially converts the behaviour of the solid particles within the region of the object to that of a liquid, reducing the shear strength of the solid and allowing the object to be more readily freed from any bind with the solid particles.

Furthermore, the ability to apply higher frequency jarring, and optionally in combination with the ability to provide increased control over the magnitude of the jarring force, may improve the ability to address any stick-slip bind between an object and a bore wall or collapsed bore wall. Conventional jars which deliver high amplitude/low frequency jarring are typically unproductive in this environment (particularly as the jar re-setting action often counters any gain made).

The jarring frequency of the apparatus may be controlled by controlling the rotational velocity of an associated rotating drive movement. Such an arrangement may provide improved control of the jarring frequency, for example by permitting the jarring frequency to be infinitely varied. This improved control may provide a significant improvement over known jarring tools in which the jarring frequency is typically dictated or limited by the time required to reset the tool.

The ability to readily control the jarring frequency, for example in an infinitely variable manner, by controlling the rotational velocity of an associated rotating drive movement may permit a user to adjust the jarring frequency in accordance with specific requirements.

The apparatus may be configured to provide a jarring frequency of, for example, between 0 Hz and 20 kHz, for example between 0.5 Hz and 5 kHz, for example between 0.5 Hz and 1 kHz, such as between 0.5 Hz and 100 Hz, for example between 0.5 Hz and 20 Hz.

In one embodiment the ability to readily vary the jarring frequency may permit an object engaged with the apparatus to be vibrated at its resonant or natural frequency (or a selected preferred harmonic frequency). This may allow the delivery of impact loading to far higher levels than would be achievable using conventional jars, yet with significantly reduced input forces. Further, when vibrating at resonant or a harmonic frequency, an elongate object, such as a tubing string, tool string or the like, may be caused to oscillate (wobble) in a sinusoidal wave pattern within the bore. This may assist greatly with reducing the level of contact between the object and the sticking medium and will significantly contribute to breaking any differential pressure type sticking (differential sticking).

The ability to vary jarring frequency may permit the apparatus to be used to provide a single jarring event.

The apparatus may comprise a plurality of rotatable jarring arrangements.

The apparatus may comprise different types of rotatable jarring arrangements to provide different jarring forces.

The apparatus may be configured to provide different jarring forces with different characteristics, for example, in terms of force amplitude, frequency or relative phase of said jarring forces.

The apparatus may be configured such that each of the rotatable jarring arrangements may be separately selected to provide a jarring force with a different characteristic.

The apparatus may be configured to provide sequential jarring forces by sequentially selecting the different rotatable jarring arrangements.

The apparatus may be configured to provide jarring forces such that the amplitude, frequency or phase of the jarring forces may be varied to preferentially provide jarring forces, for example, a higher frequency, lower amplitude jarring force to disturb the stuck object in combination with a lower frequency, higher amplitude jarring force to further disturb the stuck object.

In some embodiments the apparatus may be provided in combination with a monitoring system configured to monitor properties associated with a jarring action, for example to permit any resonant behaviour to be monitored and allow adjustment of the jarring frequency and/or magnitude accordingly. Such a monitoring system may comprise one or more sensors, such as accelerometers, vibration sensors, acoustic sensors or the like.

The apparatus may be configurable from a disabled configuration in which the impact surfaces are prevented from being axially impacted together, and a jarring configuration in which the impact surfaces are permitted to be axially impacted together and generate an impact force therebetween. As the jarring effect of the apparatus may thus only be achieved when in the jarring configuration, the apparatus may be selectively activated to provide jarring. That is, when the apparatus is configured in the disabled configuration the jarring effect may be deactivated. Accordingly, the apparatus may provide extended functionality when in its disabled configuration, such as being able to deploy and/or actuate or operate other components or objects, wherein such functionality may be difficult or impossible when the apparatus is configured in its jarring configuration.

When the apparatus is in the disabled configuration the rotatable coupling between the first and second jarring portions may permit torque to be transferred therebetween. Accordingly, in this disabled configuration the first and second portions may be rotated together, for example by a connected work string. Such ability to transmit torque between the first and second portions may permit the apparatus to be used to rotate an object engaged with the apparatus.

The first jarring portion may be configured to be rigidly coupled to a work string. The first jarring portion may be configured to be directly coupled to a work string. The first jarring portion may be configured to be indirectly coupled to a work string, for example by use of an intermediate component or structure interposed between the first jarring portion and work string. The first jarring portion may comprise a connector configured to permit connection with a work string. The connector may comprise a threaded connector or the like.

The second jarring portion may be configured to engage an object by abutting said object. The second jarring portion may be configured to be coupled to an object. The second jarring portion may be configured to be rigidly coupled to an object. The second jarring portion may be configured to be directly coupled to an object. The second jarring portion may be configured to be indirectly coupled to an object, for example by use of an intermediate component or structure interposed between the second jarring portion and object. In such an arrangement a jarring force generated within the apparatus may be transmitted to the object via the intermediate component. The second jarring portion may comprise a connector configured to permit connection with an object. The connector may comprise a threaded connector or the like.

When the apparatus is connected to a work string, said apparatus may be considered to form part of the work string.

When the apparatus is engaged or connected with an object, the apparatus and engaged or connected object may become part of the work string.

The work string may comprise any structure capable of being secured to the apparatus and for being deployed through a bore. The work string may comprise any structure capable of being rotated to impart torque to or within the apparatus, for example to the first jarring portion. The work string may comprise an elongate structure. The work string may comprise a pipe or pipe structure, such as multiple pipes or tubulars coupled together, coiled tubing or the like.

The work string may comprise a drill string or a portion of a drill string. In such an arrangement the apparatus may be configured as a drilling jarring apparatus. The work string may comprise one or more of drill pipe, drill collars, stabilisers and the like.

The work string may comprise a prop shaft coupled to a motor, such as a surface motor, downhole motor or the like, wherein said prop shaft may function to transmit torque from such a motor to or within the apparatus, such as to the first jarring portion.

The object may comprise any object which is or may be located within a bore. The object may comprise multiple components secured together. The object may comprise a downhole tool. The object may comprise a further work string. The further work string may comprise a portion of a drill string.

The object may comprise a drilling assembly, such as a bottom hole drilling assembly. The object may comprise a drill bit for use in drilling the associated bore. In such an arrangement when the apparatus is configured in a disabled configuration, torque applied to the first jarring portion via a connected work string may be transmitted to the second jarring portion and subsequently to an associated drill bit secured or engaged with the second jarring portion. Accordingly, the drill bit may be rotated to drill the bore via torque applied by the work string. In the event of the drill bit or any associated apparatus, such as any associated bottom hole assembly, becoming stuck or jammed within the bore, the apparatus may be reconfigured to the jarring configuration such that further torque applied by the work string may be used to generate the impact force and apply jarring to the drill bit or associated apparatus. This may assist to free and/or advance the drill bit and any associated apparatus.

In one embodiment the apparatus may be configured to be secured within a drill string. The apparatus may be configured to be interposed between different sections of a drill string. The apparatus may be configured to form part of a drill string.

When the apparatus is configured in the jarring configuration one of the first and second jarring portions may be rotatably fixed, and the other of the first and second jarring portions may be rotatable to permit relative rotation between the impact surfaces. One of the first and second jarring portions may be rotatably fixed by engagement with an object which is also rotatably fixed, for example by being stuck within the bore.

When the apparatus is configured in the jarring configuration one of the first and second jarring portions may be axially fixed, for example by engagement with an object which is also axially fixed, for example by being stuck in a bore. Such an arrangement may permit an axial force to be applied between the first and second jarring portions via a connected work string, for example to establish an axial force between the first and second impact surfaces.

The apparatus may be reconfigured towards the jarring configuration by application of a predetermined force between the first and second jarring portions. The predetermined force may comprise a rotational force. The predetermined force may comprise an axial force. The predetermined force may be generated by a connected work string.

The rotating jarring arrangement may provide a finite relative axial movement of the impact surfaces according to the configuration of the rotating jarring arrangement. The finite relative axial movement may restrict movement of the impact surfaces and reduce any effective impact force therebetween. The apparatus may comprise an internal tensioning mechanism to increase any effective impact force. The internal tensioning mechanism may be configured to provide tensioning or de-tensioning capabilities to permit sufficiently rapid impact of the impact surfaces to generate an impact force therebetween. The internal tensioning mechanism may be configured to provide tensioning or de-tensioning capabilities to prevent rapid impact of the impact surfaces. Tension provided by an associated work string may operate the internal tensioning mechanism.

When the apparatus is in the disabled configuration the rotatable jarring arrangement may be configured to prevent relative movement of the first and second impact surfaces to prevent an impact between the impact surfaces. The apparatus may be configured in the disabled configuration when the rotational drive movement is prevented from rotating the rotatable jarring arrangement.

When the apparatus is in the disabled configuration the rotatable jarring arrangement may be configured to permit relative movement of the first and second impact surfaces while preventing impact between the first and second impact surfaces. The apparatus may be configured in the disabled configuration when the rotational drive movement permits rotation of the rotatable jarring arrangement.

When the apparatus is in the disabled configuration the rotatable jarring arrangement may be configured to permit relative movement of the first and second impact surfaces and engagement between the first and second impact surfaces. In this disabled configuration the engagement between the impact surfaces may not generate a sufficient impact force therebetween to generate a jarring effect.

In certain embodiments the apparatus may be configured such that initial engagement of the impact surfaces during reconfiguration of the apparatus towards the jarring configuration generates an impact force between said impact surfaces. This may permit an initial jarring force to be generated during reconfiguration of the apparatus, which is then proceeded by the rotary jarring effect of the first and second impact surfaces when subsequently rotated relative to each other, for example.

The first and second impact surfaces may be axially separated when the apparatus is in the disabled configuration. In such an arrangement reconfiguration of the apparatus to the jarring configuration may be achieved by establishing relative axial movement of the first and second jarring portions to engage the impact surfaces. In one embodiment such axial movement may be permitted upon application of a predetermined axial force.

The first and second jarring portions may be configured to be axially telescoped relative to each other. Such an arrangement may permit the jarring portions to be moved axially relative to each other, for example to reconfigure the apparatus from the disabled configuration to the engaged configuration.

The first and second jarring portions may be configured to be axially coupled together. Such an axial connection may permit axial load to be transmitted between the first and second jarring portions in at least one direction. For example, such an axial connection may permit an axial load, such as an axial compression load, to be transmitted to an object via the apparatus. In one embodiment such an arrangement may permit weight to be applied to a drill bit engaged with the second jarring portion.

The axial connection between the first and second jarring portions may be releasable, for example to permit reconfiguration of the apparatus. The axial connection between the first and second jarring portions may be configured to be released upon application of a predetermined force.

The apparatus may comprise a connection arrangement configured to provide a releasable connection between the first and second jarring portions, wherein release of the connection arrangement may permit the apparatus to be configured between the disabled and jarring configurations.

The releasable connection may be configured to be released upon exposure to a predetermined force.

The connection arrangement may be configured to provide a releasable rotatable connection between the first and second jarring portions. The connection arrangement may comprise a spline arrangement. The connection arrangement may comprise at least one spline or equivalent structure mounted on the first jarring portion, and at least one corresponding spline or equivalent structure mounted on the second jarring portion. In such an arrangement the splines may be arranged to be engaged when the apparatus is in the disabled configuration, and disengaged when the apparatus is in the jarring configuration. Such disengagement of the splines may be achieved by relative axial movement of the first and second jarring portions.

The connection arrangement may comprise a radial member which extends radially between the first and second jarring portions to provide a rotatable connection therebetween, wherein said radial member may be configured to be disengaged with at least one of the first and second jarring portions, for example upon application of a predetermined force, such as a predetermined torque.

The connection arrangement may comprise a frangible component extending between the first and second jarring portions and configured to be broken, for example sheared upon application of a predetermined force.

The connection arrangement may comprise a clutch interposed between the first and second jarring portions to provide a rotatable connection therebetween. Deactivation of said clutch may be achieved upon application of a predetermined torque between the first and second jarring member. In some embodiments, in a first clutch configuration a full rotatable connection may be achieved between the first and second jarring portions. In a second clutch configuration relative rotation between the first and second jarring portions may be permitted. In the second clutch configuration the clutch may be entirely or completely disengaged such that the clutch does not interfere with relative rotation between the first and second jarring portions. In other embodiments, in the second clutch configuration the clutch may provide a degree of torque drag. Such torque drag may permit relative rotation of the first and second jarring portions during a jarring operation, yet may provide an instantaneous rotatable connection between the jarring portions, for example at the moment of release of an object being jarred.

The connection arrangement may be configured to provide a releasable axial connection between the first and second jarring portions.

The releasable axial connection may comprise a radial member which extends radially between the first and second jarring portions, wherein said radial member may be configured to be disengaged from at least one of the first and second jarring portions, for example upon application of a predetermined force, such as a predetermined axial force. Such a radial member may be defined by a key member. A plurality of radial members may be provided.

The connection arrangement may comprise a frangible component extending between the first and second jarring portions and configured to be broken, for example sheared, upon application of a predetermined force, such as a predetermined axial force.

The connection arrangement may be configured to provide a rigid axial connection such that relative axial movement of the first and second jarring portions is prevented until the connection is released.

The connection arrangement may be configured to provide a flexible axial connection between the first and second jarring portions. Such a flexible connection may permit a degree of relative axial movement between the first and second jarring portions prior to release of the axial connection. The flexible axial connection may be configured to restrict relative axial movement between the first and second jarring portions prior to release of the axial connection. Such a flexible connection may permit energy to become stored within the apparatus or associated components, such as a connected work string and/or engaged object for use in applying a jarring force between the first and second impact members upon release of the axial connection.

The connection arrangement may comprise an elastic arrangement, such as a spring arrangement, configured to be deformed upon initial relative axial movement between the first and second jarring portions prior to release of the axial connection. This elastic arrangement may be configured to store energy within the apparatus during initial relative axial movement between the first and second jarring portions. Such energy may be utilised to permit release of any axial connection, and/or to facilitate an initial impact force between the first and second impact surfaces.

The connection arrangement may define a triggering arrangement to permit the apparatus to be triggered to be configured from the disabled configuration to the jarring configuration.

The connection arrangement may be configured to provide both a releasable axial connection and a releasable rotary connection between the first and second jarring portions. In one embodiment release of the axial connection may permit the first and second jarring portions to be moved axially relative to each other, with this axial movement permitting the rotary connection to be released, for example to permit initially engaging splines of the first and second jarring portions to become disengaged, to permit a clutch to be at least partially disengaged, to disengage radial members or the like.

The apparatus may comprise a clutch assembly provided between the first and second jarring portions. The clutch assembly may be configured to establish a rotatable connection between the first and second jarring portions upon release of a stuck object which is engaged with the second jarring portion. This arrangement may permit the object to be rotated immediately upon release or unsticking which may assist in prevent the object from become stuck again, for example to assist to ream the bore. The clutch assembly may establish a predetermined drag torque between the first and second jarring portions, wherein relative rotational movement of the first and second jarring portions is permitted when this drag torque is exceeded.

The apparatus may be reconfigurable from the jarring configuration to the disabled configuration. Such an arrangement may permit the apparatus to be re-settable.

An aspect of the present invention relates to a method for use in jarring an object in a bore.

This method may be performed by use of an apparatus according to any other aspect. Accordingly, any features and/or described methods, options and functionality of the apparatus of any aspect may be assumed to also relate to this method.

The method may comprise cause relative axial movement and impact between first and second impact surfaces within a jarring apparatus, wherein said axial movement is caused by a rotational drive movement.

The method may comprise:

connecting a first jarring portion of a jarring apparatus to a work string, wherein the first jarring portion includes a first impact surface;

engaging a second jarring portion of the jarring apparatus with an object, wherein the second jarring portion includes a second impact surface; and applying a rotational drive movement to a rotatable jarring arrangement associated with at least one of the first and second jarring portions to cause relative axial movement of the first and second impact surfaces to establish axial impact therebetween and thereby applying a jarring force to the object;

The method may comprise reconfiguring the apparatus from a disabled configuration in which the first and second impact surfaces are prevented from being axially impacted together to a jarring configuration in which the first and second impact surfaces are permitted to be axially impacted together to generate an impact force therebetween.

When in the disabled configuration the impact surfaces may be axially separated, wherein the method comprises moving the impact surfaces axially relative to each other to establish engagement of the first and second impact surfaces. The method may comprise moving the first and second impact surfaces axially relative to each other to generate an impact force therebetween.

An aspect of the present invention relates to an apparatus for use in jarring an object in a bore, comprising:

a first jarring portion including a first circumferential impact surface defining an uneven surface profile; and a second jarring portion including a second circumferential impact surface also defining an uneven surface profile, wherein the first and second impact surfaces are configured to be rotated relative to each other such that rotating sliding engagement of the respective uneven surface profiles generates at least one impact force therebetween.

The first and second impact surfaces may be configured to be axially moved relative to each other to engage the first and second impact surfaces and generate a first impact force therebetween, and to be subsequently rotated relative to each other such that rotating sliding engagement of the respective uneven surface profiles generates at least a second impact force therebetween.

An aspect of the present invention relates to a downhole jarring apparatus for use in jarring an object in a bore, comprising:

a first profiled impact surface; and a second profiled impact surface, wherein the first and second impact surfaces are configured to be rotated relative to each other to cause circumferential sliding engagement of the profiled surfaces to establish an impact force between the first and second portions.

An aspect of the present invention relates to a jarring apparatus for use in jarring an object in a bore, comprising:

a first jarring portion comprising a first impact surface which defines a first circumferential profile; and a second jarring portion comprising a second impact surface which defines a second circumferential profile, wherein the apparatus is configurable between a first configuration in which the first and second impact surfaces are axially separated and the first and second portions are rotatably coupled together, and a second configuration in which the first and second impact surfaces are axially moved together to be engaged and the first and second portions are rotatably decoupled to permit relative rotational movement therebetween to cause the circumferential profiles of the engaged first and second impact surfaces to create an impact force therebetween.

An aspect of the present invention relates to a jarring apparatus for use in jarring an object in a bore, comprising:

a first impact surface; and a second impact surface, wherein a rotating drive movement is configured to rotate a rotatable jarring arrangement to sequentially axially separate and axially engage first and second impact surfaces, whereby engagement of the first and second impact surfaces generates an impact force therebetween.

Subsequent rotation of the rotating drive movement may generate subsequent impact forces.

An aspect of the present invention relates to a jarring apparatus for use in jarring an object in a bore, comprising:

an engaging member; and a circumferential surface, wherein the engaging member is configured to be engaged with the circumferential surface, and wherein the engaging member and circumferential surface is rotated circumferentially relative to each other by a rotating drive movement to sequentially axially separate and axially engage first and second impact surfaces, whereby engagement of the first and second impact surfaces generates an impact force therebetween.

Subsequent rotation of the rotating drive movement may generate subsequent impact forces.

An aspect of the present invention relates to a jarring apparatus for use in jarring an object in a bore, comprising:

a first impact surface;

a second impact surface; and a pressurising apparatus configured to pressurise and/or de-pressurise a cavity, wherein the apparatus is re-configurable between a first configuration in which the first and second impact surfaces are prevented from impacting each other, and a second configuration in which the first and second impact surfaces are subsequently impacted together through de-pressurisation of the cavity, and a third configuration in which the first and second impact surfaces are subsequently axially separated through pressurisation of the cavity.

The apparatus may be configured to cyclically pressurise and de-pressurise the cavity to permit subsequent impacts between the first and second impact surfaces, thereby providing a jarring effect.

An aspect of the present invention relates to a jarring apparatus for use in jarring an object in a bore, comprising:

a first jarring portion comprising a first impact surface; and a second jarring portion comprising a second impact surface;

wherein a rotating lobe arrangement is configured to engage with a lobe contact surface, whereupon rotation of the rotating lobe arrangement by a rotating drive movement causes relative axial movement of the first and second impact surfaces to generate an impact force therebetween.

Subsequent rotation of the rotating drive movement may generate subsequent impact events thereafter.

It should be understood that one or more features defined in relation to one aspect may be provided in combination with any other aspect.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
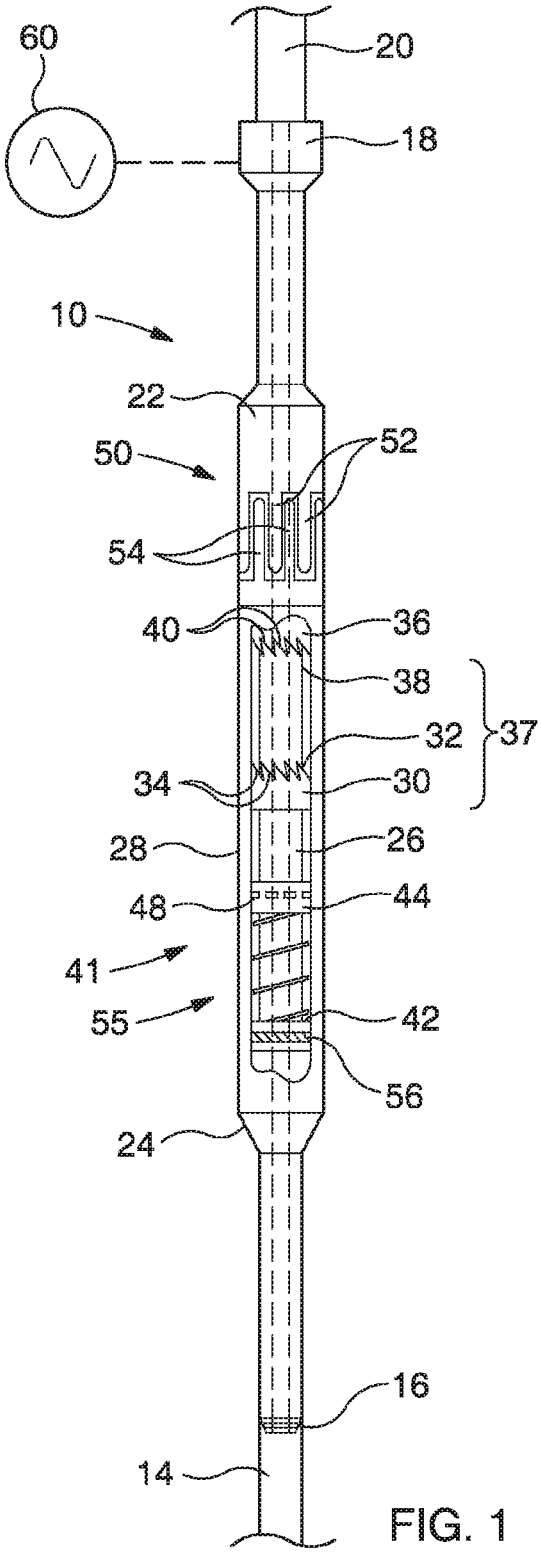
FIG. 1 is a diagrammatic illustration of a jarring apparatus according to an embodiment of the present invention, wherein the apparatus is shown in partial cut-away and configured in a disabled configuration.
Figure 2:
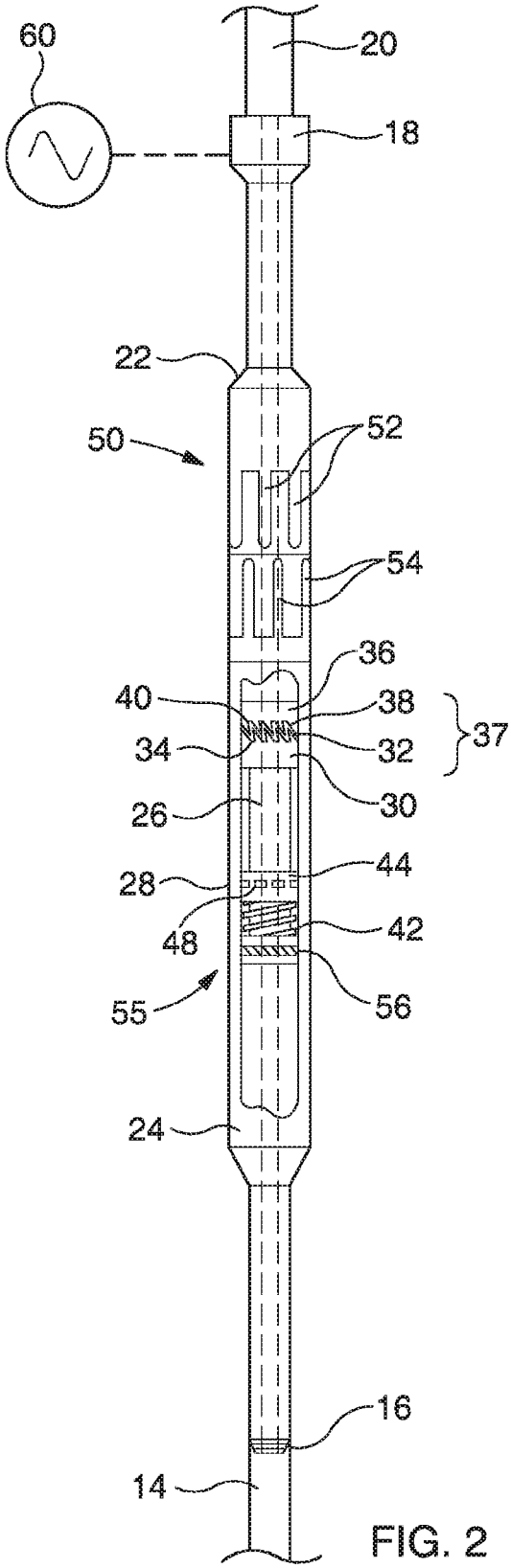
FIG. 2 is a diagrammatic illustration of the jarring apparatus of FIG. 1, shown in a jarring configuration.

A jarring apparatus, generally identified by reference numeral 10, is illustrated in FIG. 1, with a section partially cut-away to reveal internal features. The apparatus 10 is presented in a disabled configuration in FIG. 1. The apparatus 10 may be reconfigured to a jarring configuration, as illustrated in FIG. 2.

The apparatus 10 may be utilised to provide a jarring force to any object located within a bore, for example to permit freeing of the object, to permit actuation of the object or the like. However, for the purposes of the present description the apparatus is for the exemplary use of providing a jarring force to a bottom hole drilling assembly 14, which is provided in the form of a lower drilling string which carries drilling equipment, including a drill bit (not shown).

The apparatus 10 comprises a lower connector 16 which facilitates a rigid connection with the drilling assembly 14. Further, the apparatus 10 comprises an upper connector 18 which permits a rigid connection with a drill string 20 for use in deploying the apparatus 10 and connected drilling assembly 14 into a bore, and for applying torque and weight to the drilling assembly 14 to permit the bore to be drilled and advanced. The drill string 20 will typically include a combination of drill pipe and drill collars.

The apparatus 10 includes a first or upper jarring portion 22 which is connected with the drill string 20 via connector 18, and a second or lower jarring portion 24 which is connected with the bottom hole drilling assembly 14 via connector 16. As will be described in more detail below, the upper and lower jarring portions 22, 24 are configurable between a disabled configuration (FIG. 1) in which weight and torque may be transmitted between the drill string 20 and drilling assembly 14 to advance the bore, and a jarring configuration (FIG. 2) in which a jarring force may be generated therebetween to be applied to the drilling assembly 14, for example to assist in freeing this assembly in the event of becoming stuck within the bore.

The upper jarring portion 22 includes a mandrel 26 which is received within a sleeve portion 28 of the lower jarring portion 24, wherein this mandrel 26 includes an impact member 30 which includes a circumferential impact surface 32 defined by a number of circumferentially arranged teeth 34. The sleeve 28 of the lower jarring portion 24 includes a corresponding impact member 36 which also includes a circumferential impact surface 38 defined by a number of circumferentially arranged teeth 40. The impact member 30 and corresponding impact member 36 make up a rotatable jarring arrangement 37, wherein the rotatable jarring arrangement 37 provides a jarring force, as required.

The apparatus 10 comprises a releasable axial connection arrangement 41 which functions to provide a releasable axial connection between the jarring portions 22, 24. This axial connection arrangement 41 permits the jarring portions 22, 24 to be axially secured together when the apparatus 10 is in the disabled configuration of FIG. 1, and be axially decoupled to permit reconfiguration towards the jarring configuration, as in FIG. 2. As will be described in further detail below, in the present embodiment this axial connection arrangement 41 also functions as a triggering mechanism to permit the apparatus 10 to be reconfigured towards the jarring configuration.

The axial connection arrangement 41 is provided by a shoulder 42 on a lower end of the mandrel 26, a release ring 44, and a spring member 46 which extends between the shoulder 42 and a release ring 44. When in the disabled configuration, as shown in FIG. 1, the release ring 44 is rigidly secured to the sleeve 28 of the lower jarring portion 24 via a number of releasable keys 48. The connection arrangement 41 permits the jarring portions 22, 24 to be axially secured together in the disabled configuration such that the impact members 30, 36 are axially separated and the respective impact surfaces 32, 38 are disengaged. As will be described in further detail below, the axial connection arrangement 41 may be released upon application of a predetermined axial force, applied via the drill string 20, which causes the keys 48 to release and decouple the release ring 44 from the sleeve 28.

The apparatus 10 further comprises a releasable rotary connection arrangement 50 which permits the jarring portions 22, 24 to be rotatably connected together when the apparatus 10 is in the disabled configuration of FIG. 1, and rotatably decoupled when the apparatus is in its jarring configuration of FIG. 2. This rotary connection arrangement 50 permits the transmission of torque between the jarring portions 22, 24 when the apparatus 10 is in the disabled configuration.

The rotary connection arrangement 50 comprises a plurality of circumferentially distributed and axially extending spline members 52 provided on the upper jarring portion 22, and a plurality of corresponding spline members 54 provided on the lower jarring portion. When the respective spline members 52, 54 are intermeshed, as in FIG. 1, a rotatable coupling between the jarring portions 22, 24 is achieved. This rotatable coupling may be released by axially separating the jarring portions 22, 24 to disengage the splines 52, 54, as shown in FIG. 2. Such axial separation may be permitted following release of the axial connection arrangement 41, as described in more detail below.

However, in some embodiments the separate rotary connection arrangement 50 may not be essential, and the rotary connection may be achieved by the axial connection arrangement 41. For example, the keys 48, when extended, may permit torque to be transferred between the jarring portions 22, 24. As such, the separate spline arrangement 52, 54 may be omitted.

The operation of the apparatus 10 will now be described, with reference to both FIGS. 1 and 2.

The apparatus 10 is initially configured in the disabled configuration, as show in FIG. 1, and secured to both the drilling assembly 14 and the drill string 20. A bore may then be drilled, with weight and torque being transmitted through the apparatus 10 to the drilling assembly 14.

If the drilling assembly 14 should become stuck within the bore, for example due to collapse of the bore, the apparatus 10 may then be reconfigured to the jarring configuration, as in FIG. 2. In this respect, tension may be established within the drill string 20, for example by pulling upwardly from surface, to thus apply an axial force between the first and second jarring portions 22, 24, with the second jarring portion 24 providing a reaction to this axial force by being rigidly secured to the stuck lower drilling apparatus 14.

The applied axial force will initially cause the spring member 46 to become compressed between the shoulder 42 and the release ring, permitting energy to become stored within the entire system. Once the axial force reaches a predetermined magnitude, the keys 48 of the release ring 44 will be deactivated, thus releasing the connection between the jarring portions 22, 24, with the stored energy being released and the upward axial force applied by the drill string 20 causing the upper jarring portion 22 to move upwardly relative to the lower jarring portion 24 at a relatively high velocity until the surfaces 32, 38 of the respective impact members 30, 36 impact each other, generating an impact force therebetween. This initial impact force may function to jar the stuck drilling assembly 14, and contribute towards freeing this. This upward movement of the upper jarring portion 22 also disengages the splines 52, 54 of the rotary connection arrangement 50, permitting the jarring portions 22, 24 to become rotatably decoupled. However, as noted above, the keys 48 may alternatively provide a rotary coupling, such that release of the keys 48 also releases the rotary coupling.

Once the apparatus 10 is configured in this jarring configuration, and if the initial jarring force generated by initial impact of the impact members 30, 36 did not free the drilling assembly 14, tension is applied to the drill string 20 to pull on the upper jarring portion 22 and press the impact surfaces 32, 38 together, and the drill string 20 also rotated to rotate the upper jarring portion 22 relative to the lower drilling portion 24. This relative rotation establishes rotating sliding engagement of the surfaces 32, 38, such that interaction of the teeth 34, 40 causes the surfaces 32, 38 to continuously be separated and reengaged, thus establishing a repeated impact force therebetween, which will providing jarring to the stuck drilling assembly 14 through the lower jarring portion 24. This jarring may effectively assist to free the drilling assembly 14.

The apparatus 10 further comprises a clutch arrangement 55 which includes a clutch member 56 in engagement with the sleeve 28 of the lower jarring portion 24 to establish a drag torque therebetween. When the lower jarring portion 24 is fixed within the bore due to engagement with a stuck drilling assembly 14, the drill string 20 will be will be required to establish a torque which exceeds the drag torque of the clutch arrangement 55 to establish rotation of the upper jarring portion 22. If at any time during relative rotation and jarring between the upper and lower jarring portions 22, 24 the lower jarring assembly 24 should become free, for example due to release of the drilling assembly 14, the drag torque established by the clutch arrangement 55 will permit the upper and lower jarring portions 22, 24 to be rotatably coupled. This may therefore permit the drill string 20 to rotate the lower jarring portion 24 and connected drilling assembly 14, which may assist in further freeing of the drilling assembly 14, for example by permitting cleaning or reaming of the bore during this established rotation.

In some embodiments, the clutch arrangement 55, or a separate clutch arrangement (not shown), may provide a releasable rotary connection between the jarring portions.

The magnitude of the jarring force achieved may be readily adjusted by adjusting the axial force applied by the drill string 20. Further, the frequency of jarring may be readily adjusted by adjusting the rotational velocity of the drill string 20. Such a level of control of the jarring force and jarring frequency is not possible with prior art jarring methods.

This particular jarring arrangement provided by the apparatus 10 provides a number of advantages. For example, the ability to generate a jarring force in an axial direction by interaction of the teeth 34, 40, in combination with the application of a near constant uni-axial loading on the stuck portion by the drill string 20, improves the effect of the apparatus 10 to free the drilling apparatus 14.

Also, the ability to generate a repeated jarring force will permit higher jarring frequencies to be achieved in relation to prior art methods. The ability to generate a higher jarring frequency may permit the apparatus 10 to impart vibration to associated equipment, such as the drilling assembly 14. In this respect, a higher jarring frequency or application of a vibratory force to any solid particulate which is in contact with the apparatus 10, drill string 20 or drilling assembly 14, for example due to collapse of the surrounding bore, may result in a condition termed 'Solid Particulate Liquefaction'. This phenomenon essentially converts the behaviour of the solid particles to that of a liquid, reducing the shear strength of the solid and allowing the apparatus or associated object or equipment to be more readily freed from any bind with the solid particles.

Furthermore, the ability to apply higher frequency jarring may improve the ability to address any stick-slip bind between an object and a bore wall or collapsed bore wall.

Also, the ability to readily vary the jarring frequency by controlling the rotational velocity of the drill string 20 may permit the drilling assembly 14, for example, to be vibrated at its resonant or natural frequency (or a selected preferred harmonic frequency). This may allow the delivery of impact loading to far higher levels than would be achievable using conventional jars, yet with significantly reduced input forces. Further, when vibrating at resonant or a harmonic frequency, the drilling assembly 14, which may be elongate in nature, may be caused to oscillate (wobble) in a sinusoidal wave pattern within the bore which may assist in addressing certain sticking phenomenon within the ore, such as differential sticking.

In some embodiments the apparatus 10 may be provided in combination with a live active monitoring system 60 to permit any resonant behaviour to be monitored and allow adjustment of the jarring frequency and/or magnitude accordingly.

In the present embodiment the apparatus 10 may be resettable such that drilling may be continued following a successful jarring operation. For example, when the drilling assembly 14 has become free, this may be engaged with the bottom of the bore and weight applied via the drill string 20 to thus move the upper jarring portion 22 downwardly relative to the lower portion 24 until the keys 48 of the release ring 44 reengage with the sleeve 28 to re-establish the axial connection, and until the splines 52, 54 interengage, thus re-establishing the rotary connection. As noted above, in some embodiments the releasable connection may alternatively or additionally be achieve by the keys 48 and/or a clutch.

The ability to reset the apparatus may not only permit drilling to continue, but may also facilitate multiple initial jars to be achieved.

In the embodiment described above, the impact surfaces 32 and 38 form part of the rotatable jarring arrangement 37 in that the sliding interaction of the impact surfaces results in generation of jarring force. However, the impact surfaces could be configured separately or remotely from the rotatable jarring arrangement such that the impact surfaces generate the jarring force by responding to axial translation provided by a separate or remote jarring arrangement. In such a modification, the impact surfaces could be planar.

Figure 3A:
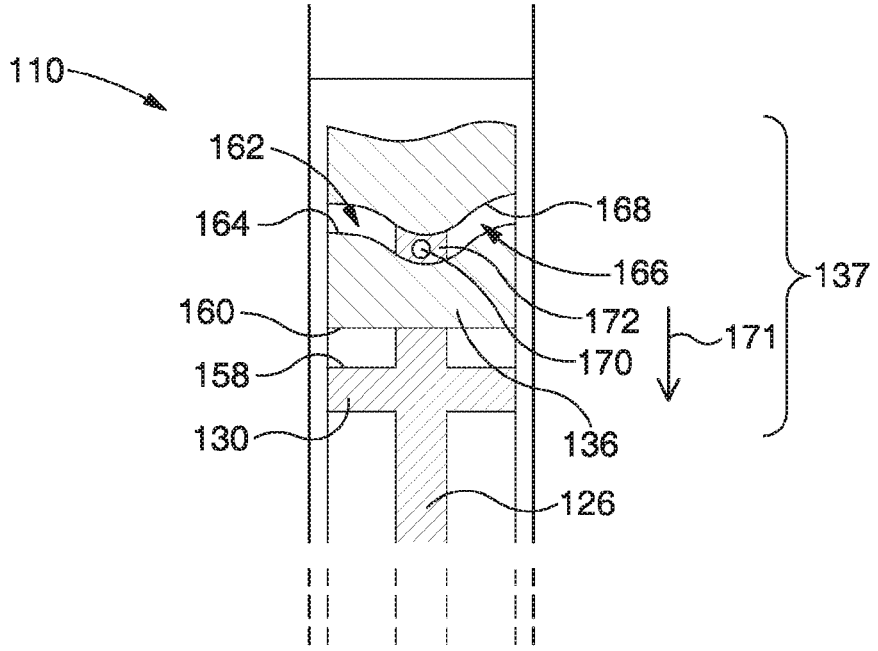
FIGS. 3*a* and 3*b* illustrate a sequential operation of a jarring apparatus according to a further embodiment of the present invention.
Figure 3B:
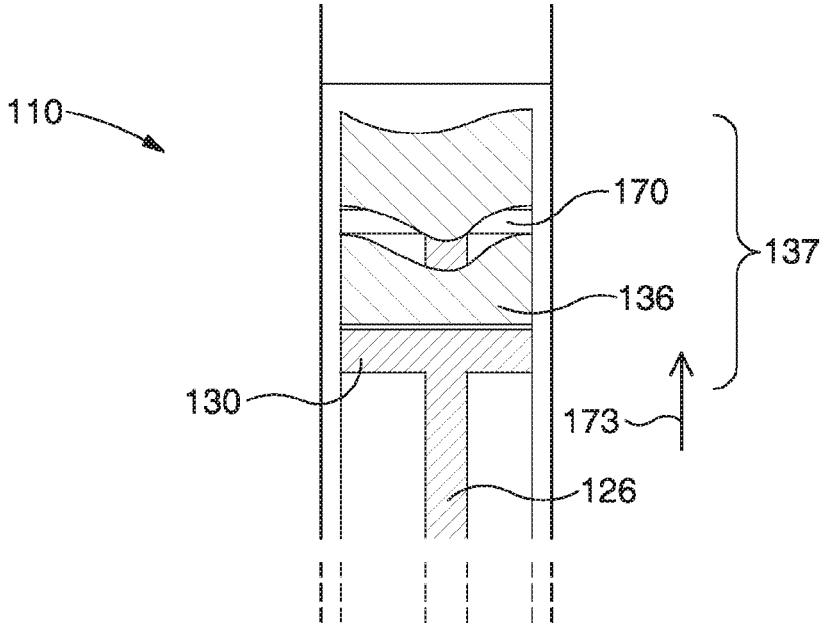

FIGS. 3*a* and 3*b* illustrate a part-sectional diagrammatic view of an alternative embodiment of a jarring apparatus 110 which is provided with a rotatable jarring arrangement 137 which comprises a mechanism for effecting axial movement which is different to the aforementioned rotatable jarring arrangement 37 of FIGS. 1 and 2. The rotatable jarring arrangement 137 is interposed between first and second jarring portions of the apparatus 110.

The apparatus comprises first and second impact surfaces 158, 160 and the rotatable jarring arrangement 137 is positioned remotely from the impact surfaces. A slot 162 is defined by a region between a first surface profile 164 and a second surface profile 168. The surfaces 162, 166 shown in FIG. 3*a* accommodate a engaging member 170 therebetween, wherein impact members 130, 136 are shown configured to be separated axially, as depicted by arrow 171. The engaging member 170 is connected to rotating axle 172 which effects rotating drive movement upon engaging member 170. Rotation of engaging member 170 within the slot 162 results in relative axial movement of the impact members 130, 136, wherein the impact surfaces 158, 160 are impacted together in a direction indicated by arrow 173 to generate an impact force therebetween, as shown in FIG. 3*b*. Further rotation of engaging member 170 results in separation of impact surfaces 158, 160, and if necessary further subsequent impact of impact surfaces 158, 160 upon further relative rotation of engaging member 170 and the additional surfaces 162, 166.

During use, impact members 130, 136 impact together according to movement of the engaging member within the slot 162. In the presently envisaged embodiment the engaging member 170 is in contact with both additional surfaces 162 and 166. However, only one additional surface needs to be in engagement with the engaging member 170, for example, in this embodiment only the additional surface 166 may be engaged with uneven surface profile 168 as impact member 130 would be pushed against additional surface 166 when held under tension provided by a drilling assembly (not shown in the present embodiment) and drill string (not shown in the present embodiment). In other embodiments the converse may provide the appropriate engagement between either of additional surfaces 162 or 166 and engaging member 170. In an alternative embodiment (not shown) the apparatus may include co-operating annular members in place of the engaging member 162.

Figure 4A:
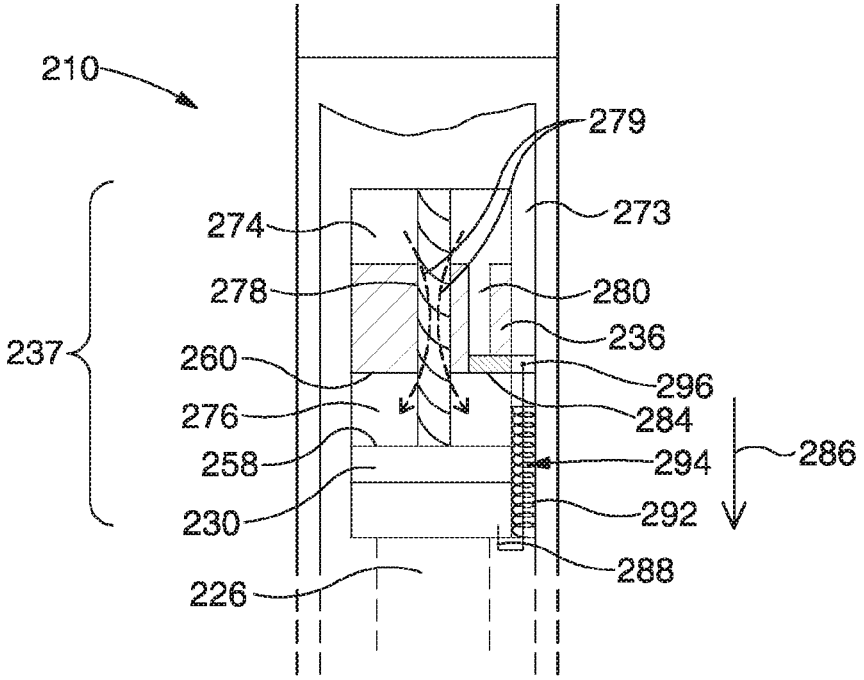
FIGS. 4*a* to 4*c* illustrate a sequential operation of a jarring apparatus according to a further embodiment of the present invention.
Figure 4B:
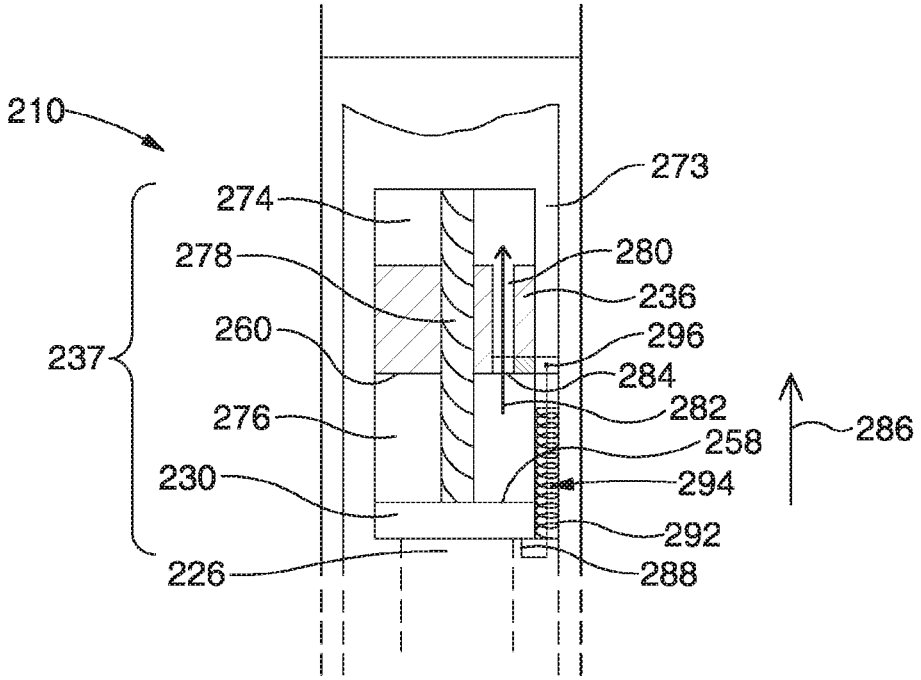
Figure 4C:
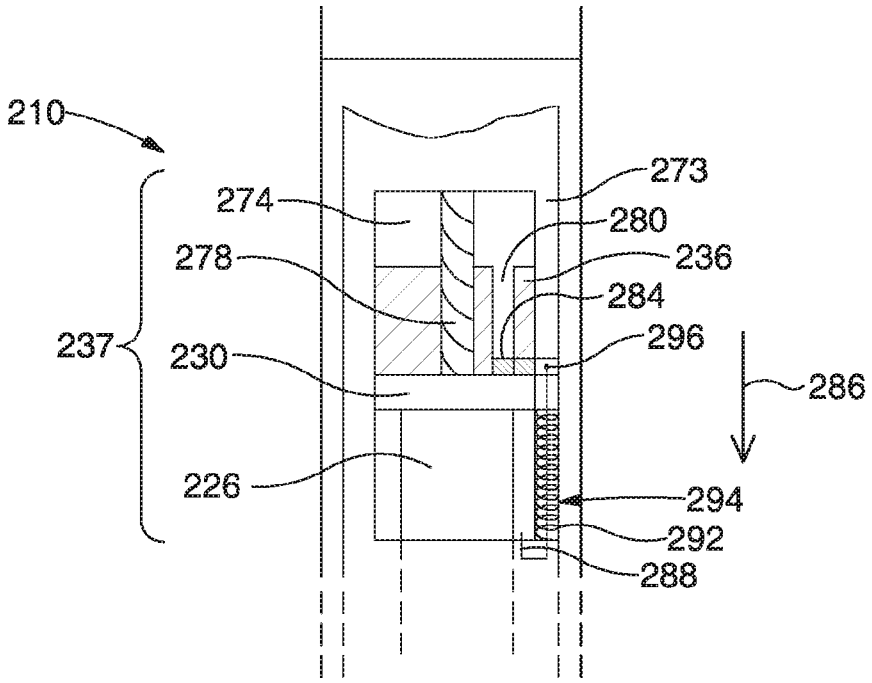

FIGS. 4*a* to 4*c* illustrate part-sectional diagrammatic views of an alternative embodiment of a jarring apparatus 210 which is provided with a pressurising mechanism for effecting axial movement of the first and second impact surfaces. FIGS. 4*a* to 4*c* show different stages of operation during use of the jarring apparatus described in the second additional embodiment.

The apparatus 210 comprises a housing 273 comprising first and second impact members 230, 236. The first impact member 230 separates first and second fluid reservoirs 274, 276. The second impact member 236 axially encloses the second fluid reservoir 276 with first and second impact surfaces 258, 260 disposed therebetween. A pump 278, for example, a progressive cavity pump, is disposed between the first and second fluid reservoirs and configured to communicate actuating fluid from the first fluid reservoir 274 to the second fluid reservoir 276 upon relative rotation of the pump 278 and the first impact member 236. The relative rotation of the pump 278 and first impact member 236 is achieved by rotation of a rotating drive movement, thereby transferring actuating fluid from the first fluid reservoir 274 to the second fluid reservoir 276 in a direction generally indicated by arrows 279. A channel 280 is provided between first and second fluid reservoirs 274, 276 to provide communication of actuating fluid therebetween. Actuating fluid is communicated from the second fluid reservoir 276 to the first fluid reservoir 274 through channel 280 in a direction indicated by arrow 282 in FIG. 4*b*. Communication of fluid using channel 280 is selectively provided using valve 284.

The communication of actuating fluid from the first fluid reservoir to the second fluid reservoir results in an increase in fluid pressure in the second fluid reservoir which results in the axial separation of the second impact surface 260 relative to the first impact surface 258 in a direction indicated by arrow 286 in FIG. 4*a*.

A valve 284 prevents communication of actuating fluid via channel 280. A limit trigger 288 is provided to define a threshold beyond which de-pressurisation of the second fluid reservoir occurs due the valve 284 permitting actuating fluid communication from the second fluid reservoir 276 to the first fluid reservoir 274 via channel 280. The limit trigger 288 may be activated upon reached a mechanical limit in terms of relative separation of the impact members, a pressure limit or the like. In the embodiment shown the valve 284 is activated or de-activated through a trigger system comprising a trigger member 292, trigger spring 294 which are connected via trigger connector 296 to rotate the valve 284 to permit or prevent actuating fluid communication through channel 280. Alternative valve or channel arrangements may be envisaged whose pressurisation and de-pressurisation functions are equivalent to the embodiment described herein.

FIGS. 4*a* to 4*c* illustrate a sequence of events within a cycle of pressurisation and de-pressurisation of the apparatus. FIG. 4*a* illustrates pressurisation of the second fluid reservoir, thereby axially separating the first and second impact members. FIG. 4*b* illustrates the impact members at their maximum axial separation, as defined by the trigger limit 288, upon reaching which the valve 284 permits communication of actuating fluid from the second fluid reservoir 276 to the first fluid reservoir 274 via channel 280. Valve 284 may be configured to permit communication of actuating fluid for a pre-defined unit of time. Tension provided between the first and second jarring portions results in rapid de-pressurisation of the second fluid reservoir 276 to permit axial engagement of the first and second impact surfaces, and hence impact therebetween. Subsequent to the impact of the impact surfaces, the valve 284 closes to permit subsequent re-pressurisation of the second fluid reservoir 276.

FIGS. 4*a* to 4*c* are representative of a cycle of pressurisation and de-pressurisation events to generate a jarring effect. Multiple jar events could be generated by cyclically operating the apparatus. Alternative configurations of the apparatus described herein could be conceived to equivalently generate the jarring effect.

Figure 5A:
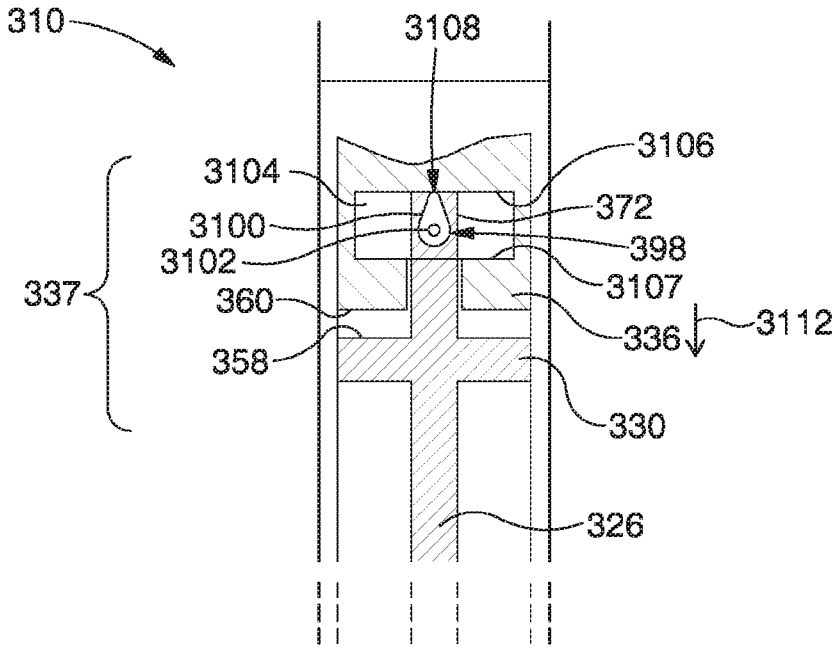
FIGS. 5*a* and 5*b* illustrate a sequential operation of a jarring apparatus according to a further embodiment of the present invention.
Figure 5B:
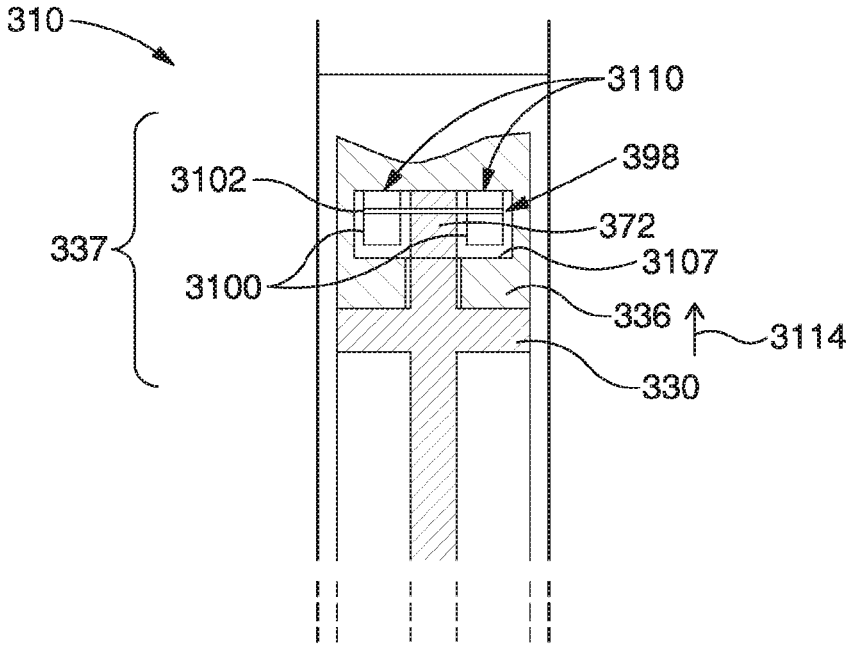
Figure 6A:
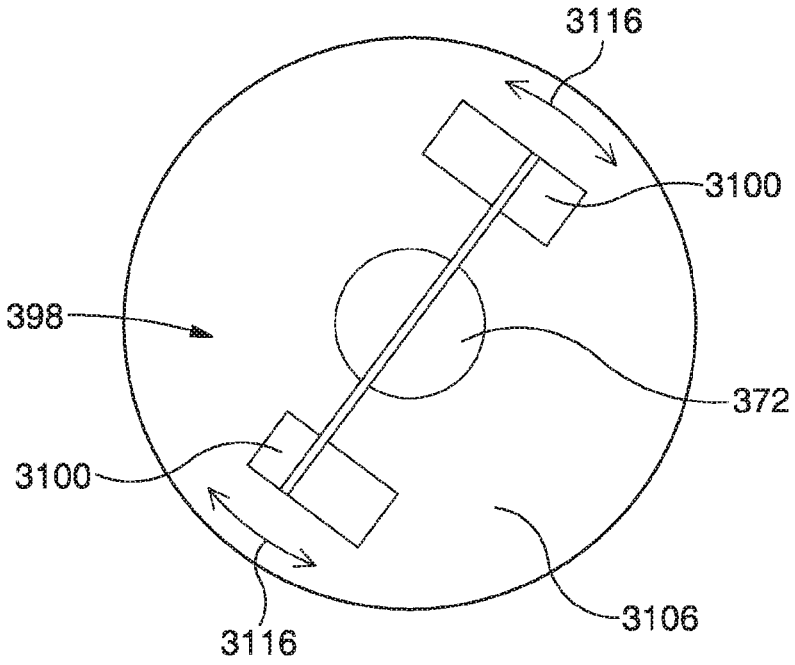
FIG. 6*a* is an axial view of a rotatable jarring arrangement of the jarring apparatus in FIGS. 5*a* and 5*b*.

FIGS. 5*a* to 5*b* illustrate part-sectional diagrammatic views of an alternative embodiment of a jarring apparatus 310 which is provided by a rotating jarring arrangement 337 which comprises a rotating lobe arrangement for effecting relative axial movement of the first and second impact surfaces. FIG. 6*a* shows an axial view of the rotating jarring arrangement 337 and FIG. 6*b* (i)-(iv) show representative side views of the rotating jarring arrangement during a rotational cycle of the apparatus.

In reference to FIGS. 5*a* and 5*b* the apparatus 310 comprises a first impact member 330, which is associated with one of the first or second jarring portions, and second impact member 336, which is associated with the other of the first or second jarring portions. First impact member 330 comprises a first impact surface 358. Second impact member 336 comprises a second impact surface 360. The rotating jarring arrangement 337 is rotated by a rotating drive movement directed through axle 372, which effects rotation of rotating lobe arrangement 398. Rotating lobe arrangement 398 comprises at least one lobe 3100, which rotates about a radially extending axis 3102. In the depicted embodiment there are provided a plurality, namely two, of lobe 3100, as shown in FIG. 5*b*. Rotating lobe arrangement 398 is housed in an accommodating region 3104, which is axially remote from the impact members 330 and 336. The accommodating region 3104 comprises upper contact surface 3106 and lower contact surface 3107. In the present embodiment, the upper contact surface 3106 of the accommodating region 3104 is maintained in engagement with a circumferential position on lobe contact surface, for example, shown by 3108 in FIG. 5*a* and 3110 in FIG. 5*b*. Rotating drive movement of the rotating lobe arrangement 398 translates the lobe 3100 in a circumferential path while in engagement with upper contact surface 3106. During translation in the circumferential path, frictional force applied between lobe 3100 and upper contact surface 3106 results in subsequent rotation of the lobe 3100 about the radially extending axis 3102. The lobe 3100 are configured to effect relative axial movement of the first and second impact surfaces 358 and 360 via axle 372 upon rotation of the lobes 3100 relative to upper contact surface 3106.

Figure 6B:
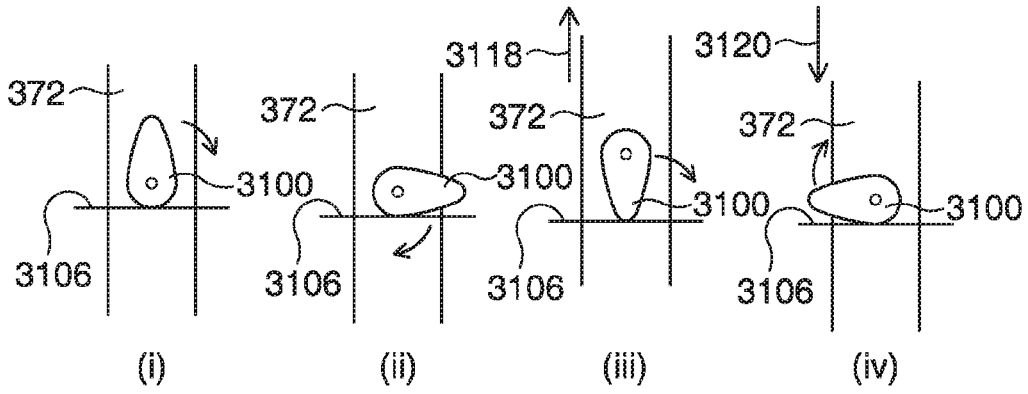
FIG. 6*b* is a sequence of side views of a rotating lobe arrangement of the jarring apparatus in FIGS. 5*a* and 5*b* during a rotation cycle.

In reference to FIGS. 6*a* and 6*b* (i)-(iv) to support FIGS. 5*a* and 5*b*, different partial views of the apparatus 310 are shown. The first impact surface 358 is shown in its maximum axial separation from second impact surface 360 in FIG. 5*a*, as indicated by direction arrow 3112. Upon subsequent rotation of the rotating lobe arrangement 398, the impact surfaces are shown at or during impact in FIG. 5*b*, as depicted by direction arrow 3114. Axial rotation 3116 of the rotating lobe arrangement 398 is depicted in FIG. 6*a*. A cycle of lobe rotation is shown in FIG. 6*b* (i)-(iv) in which the lobe 3100 is shown during a cycle of rotation. Tension applied via the first and second jarring portions stores energy within the apparatus such that when the lobe in shown to provide maximum impact surface separation, as indicated in FIG. 6*b* (iii) and indicated by arrow 3118, subsequent rotation of the lobe, as in FIG. 6*b* (iv) the rotation of lobe 3100 causes relative rapid axial movement of the impact in a direction depicted by arrow 3120 in FIG. 6*b* (iv).

It should be understood that tension applied to the apparatus via the work string plays an important part in defining the amplitude of impact between first and second impact surfaces in that the resulting stored energy increases impact force therebetween. In an alternative embodiment the lobe 3100 may be configured to be in contact with lower contact surface 3107. In an alternative embodiment the coefficient of friction between the lobe 3100 and lobe contact surface may be adjusted to permit sliding engagement therebetween such that the rotating lobe arrangement 398 remains rotationally static with rotation of the lobes about the radially extending axis being actuated by a differential mechanism, which is rotated by a rotating drive movement derived from the central axis of the jarring apparatus, thereby maintaining its definition as a rotary jarring apparatus.

It should be understood that the embodiments described herein are merely exemplary and that various modifications may be made thereto without departing from the scope of the invention. For example, any suitable mechanism may be utilised which can translate a rotational drive movement to an axial impact movement of impact surfaces. As such, axial impact may be controlled and initiated by a rotary action or drive. Further, the jarring apparatus is not exclusively for use in drilling applications, and may be used in any application in which an object requires jarring in a bore.

The invention claimed is:

1. A downhole jarring apparatus for use in jarring an object in a bore, comprising:

a first jarring portion including a first impact surface;

a second jarring portion including a second impact surface; and a pressurising apparatus operable by a rotational drive movement to cause relative axial movement of the first and second impact surfaces to establish axial impact therebetween.

2. The downhole jarring apparatus according to claim 1, wherein the pressurising apparatus provides fluid communication of an actuating fluid between first and second fluid reservoirs, for use in facilitating impact between the first and second impact surfaces.

3. The downhole jarring apparatus according to claim 2, wherein the pressurising apparatus is configured to vary pressure between the first and second jarring portions to facilitate relative axial movement between the first and second impact surfaces.

4. The downhole jarring apparatus according to claim 2, wherein the pressurising apparatus is configurable between:

a pressurising stage, wherein the second fluid reservoir is pressurised; and depressurising stage, wherein the second fluid reservoir is depressurised.

5. The downhole jarring apparatus according to claim 4, wherein the pressurising apparatus is configurable in the pressurising stage to cause relative axial separation of the first and second impact surfaces by communicating actuating fluid from the first fluid reservoir to the second fluid reservoir to pressurise the second fluid reservoir, thereby forcing the first and second impact surfaces to separate relatively in an axial direction.

6. The downhole jarring apparatus according to claim 4, wherein the pressurising apparatus is configurable in the depressurising stage to depressurise the second fluid reservoir by communicating actuating fluid from the second reservoir to the first reservoir via a pressure release system, thereby permitting the first and second impact surfaces to move axially together such that an impact force is generated therebetween.

7. The downhole jarring apparatus according to claim 4, wherein the pressurising apparatus is configured to cycle between the de-pressurising stage and the pressurising stage to facilitate cyclical impact between the first and second impact surfaces.

8. The downhole jarring apparatus according to claim 2, wherein the pressurising apparatus comprises a valve system.

9. The downhole jarring apparatus according to claim 8, wherein the valve system is configured to prevent fluid communication between the first and second reservoirs, thereby permitting re-pressurisation of the second reservoir according to rotational drive movement of the pressurising apparatus.

10. The downhole jarring apparatus according to claim 2, wherein the pressurising apparatus is configurable in a disabled stage, wherein the pressurising apparatus is prevented from providing fluid communication between first and second fluid reservoirs.

11. The downhole jarring apparatus according to claim 1, comprising a fluid cavity for receiving an actuating fluid.

12. The downhole jarring apparatus according to claim 11, wherein the pressurising apparatus retains pressure in the cavity during axial separation of the first and second impact surfaces.

13. The downhole jarring apparatus according to claim 11, wherein the pressurising apparatus is configured to depressurise the cavity to permit the first and second impact surfaces to be impacted together.

14. The downhole jarring apparatus according to claim 11, wherein the pressurising apparatus is configured to pressurise and depressurise the cavity, and wherein the apparatus is reconfigurable between:

a first configuration in which the first and second impact surfaces are prevented from impacting each other;

a second configuration in which the first and second impact surfaces are subsequently impacted together through depressurisation of the cavity; and a third configuration in which the first and second impact surfaces are subsequently axially separated through pressurisation of the cavity.

15. The downhole jarring apparatus according to claim 14, wherein the apparatus is configured to cyclically pressurise and depressurise the cavity to permit subsequent impacts between the first and second impact surfaces.

16. The downhole jarring apparatus according to claim 1, wherein the pressurising apparatus is configured to receive rotational drive from a rotational drive mechanism.

17. The downhole jarring apparatus according to claim 1, wherein the apparatus is configurable from a disabled configuration in which the impact surfaces are prevented, from being axially impacted together, and a jarring configuration in which the impact surfaces are permitted to be axially impacted together and generate an impact force therebetween.

18. The downhole jarring apparatus according to claim 17, wherein the apparatus is reconfigurable from the jarring configuration to the disabled configuration such that the apparatus is re-settable.

19. A method for use in jarring an object in a bore, comprising:

engaging a downhole jarring apparatus according to claim 1 with the object; and applying a rotational drive movement to or within the apparatus to cause relative axial movement and impact between first and second impact surfaces within the jarring apparatus.

20. A downhole jarring apparatus for use in jarring an object in a bore, comprising:

first and second impact surfaces configured to be axially separated and impacted together to generate a jarring force;

a cavity configured to be pressurised during axial separation of the first and second impact surfaces; and a rotatable jarring arrangement operable by a rotational drive movement to depressurise the cavity to permit the first and second impact surfaces when axially separated to be axially impacted together.

* * * * *